United States Patent [19]

Liu

[11] Patent Number: 5,070,633

[45] Date of Patent: Dec. 10, 1991

[54] CRYSTAL BALL HAVING REVOLVING EXTERNAL CONFIGURATION

[76] Inventor: J. H. Liu, No. 3, Alley 202, Kao- Fon Rd., Hsin-Chu City, Taiwan

[21] Appl. No.: 563,621

[22] Filed: Aug. 7, 1990

[51] Int. Cl.[5] ..... G09F 19/08

[52] U.S. Cl. ..... 40/411; 40/415; 272/31 R; 84/95.2; 74/63

[58] Field of Search ..... 40/409, 410, 411, 414, 40/423, 430, 440, 473, 415; 446/236, 265; 272/31 R; 84/94.1, 94.2, 95.1, 95.2; 74/63; 464/157, 162, 185

[56] References Cited

U.S. PATENT DOCUMENTS

| | | | |
|---|---|---|---|
| 1,655,292 | 1/1928 | Przybylko et al. | 446/236 |
| 2,840,949 | 7/1958 | Faulkner | 84/95.2 |
| 3,082,570 | 3/1963 | Pearson, Jr. | 40/411 |
| 3,349,661 | 10/1967 | Searls | 84/94.2 |
| 4,344,243 | 8/1982 | Reszka | 40/414 |
| 4,573,939 | 3/1986 | Hoshino | 272/31 R |
| 4,910,897 | 3/1990 | Hsu | 272/31 R |

FOREIGN PATENT DOCUMENTS

07/563621 11/1989 Taiwan .

*Primary Examiner*—Kenneth J. Dorner
*Assistant Examiner*—Brian K. Green
*Attorney, Agent, or Firm*—Larson & Taylor

[57] ABSTRACT

This invention relates to a crystal ball having a revolving cover or globe. The crystal ball comprises the torque shaft of a spring driven, music bell, which shaft protrudes from the lower end of the base of the crystal ball, and is fixed to a fixed base. The fixed base envelopes or clads the outside of the casing of the crystal ball, and has an annular gear or rack mounted at the upper end of the fixed base. A radial protrusion at the upper end of the casing of crystal ball has a plurality of vertical orifices, each rotatably mounting a stage comprised of a shaft having a platform fixed to the upper end and a gear fixed at the lower end, the gear engaging the annular rack. By the aforesaid construction, when the torque axle provides a rotational torque to the fixed base due to the spring of the music bell, the crystal ball spins about an axis on a positioning member disposed at the center of the fixed base. Furthermore, as the crystal ball is spinning around, the stages will also spin around, thus making the aforesaid crystal ball give a versatile, dynamic landscape.

9 Claims, 4 Drawing Sheets

CRYSTAL BALL HAVING REVOLVING EXTERNAL CONFIGURATION

BACKGROUND OF THE INVENTION

This invention relates to crystal balls containing ornaments. In particular, this invention relates to a crystal ball having a revolving external configuration.

DESCRIPTION OF THE PRIOR ART

Generally speaking, the design of prior art crystal balls has evolved from a static landscape to a dynamic landscape, and has provided more diversified changes of the landscape for the crystal ball. However, the general manufacturers of crystal balls having a dynamic landscape tend to concentrate on the representation rotation, swinging and other movement patterns of the doll within the main portion of the crystal ball for the design of structure. Therefore, certain limitations from such design structure of configuration prevent having more changes in the landscape. An example of this prior art is depicted in a previously granted patent in Taiwan with No. 78204979 entitled "Configuration of Crystal Ball with Dynamic Landscape".

SUMMARY OF THE INVENTION

Accordingly, the inventor has made an improvement on the prior art crystal balls to permit them to display multiple changes and have a simplified construction of a revolving stage. Furthermore, by means of a torque axis of the music bell of the crystal ball and the incorporation of a fixed a base, the glass ball of said crytal ball spins around while the doll stands still within the main portion of the crystal ball. This gives multiple changes of landscape as the main object of this present invention.

In one embodiment, the crystal ball uses a music bell at the base of the crystal ball as the source for driving a spring torque shaft fixed to a fixing base located outside the casing of the crystal ball. The crystal ball revolves against the fixing base so that the crystal ball can display the landscape varieties appearing on the external glass ball against a stationary doll within. During the revolving of the crystal ball, a plurality of revolving stage platforms or disks located at equal distance on a protrusion of the crystal ball casing also individually rotate as well as move around with said protrusion. The disks spin on their axes, being driven by a gear engaged with an annual rack mounted to the fixed base and located in between the protrusion and the fixed base. Thus the crystal ball can present a multiplexed, dynamic landscape.

BRIEF DESCRIPTION OF THE DRAWINGS

The present invention will become more readily apparent from the following description of the preferred embodiment of the present invention taken in conjunction with the accompanying drawing, in which.

DESCRIPTION OF THE PREFERRED EMBODIMENT

Figure 5:
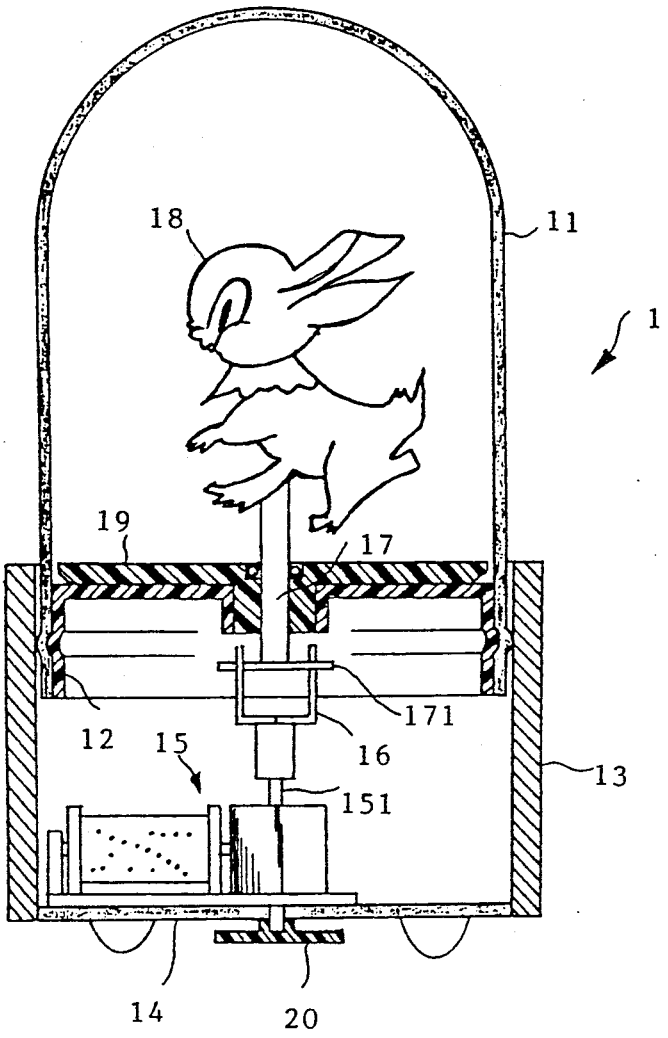
FIG. 5 (PRIOR ART)
FIG. 5 is a cross-sectional view of a crystal ball of the prior art.

As shown in FIG. 5, there is depicted a crystal ball 1 of the prior art shown in the state of revolving. Crystal ball 1 has a doll 18 and it essentially comprises a glass ball or cover 11, a rubber plug seat 12 shaped to the shape of the lower end of glass ball 11, a fixed disk 19 disposed above the rubber plug seat 12, and a passive shaft, axle or axis 17 which will revolve and which extends through the center of rubber plug seat 12 and fixed disk 19. Shaft 17 includes a lateral bar 171 mounted at its lowest end. A music bell 15 is fixedly mounted below said passive axis 17 onto the base 14, and is connected to bar 171 with a resilient grip 16 and is fitted onto a torque shaft, axle or axis 151 at the upper end of the spring of music bell 15. A wrench 20 is located beneath the base 14 and connected onto the bottom end of torque axle 252 which protrudes from the lower end of the spring of music bell 15. Wrench 20 is used to wind the spring, and the resulting torque will start to revolve torque axle 151. This revolving axis 151, through resilient grip 16 and the lateral bar 17, then activates doll 18, fixed to the upper end of passive axis 17, to spin around.

Figure 1:
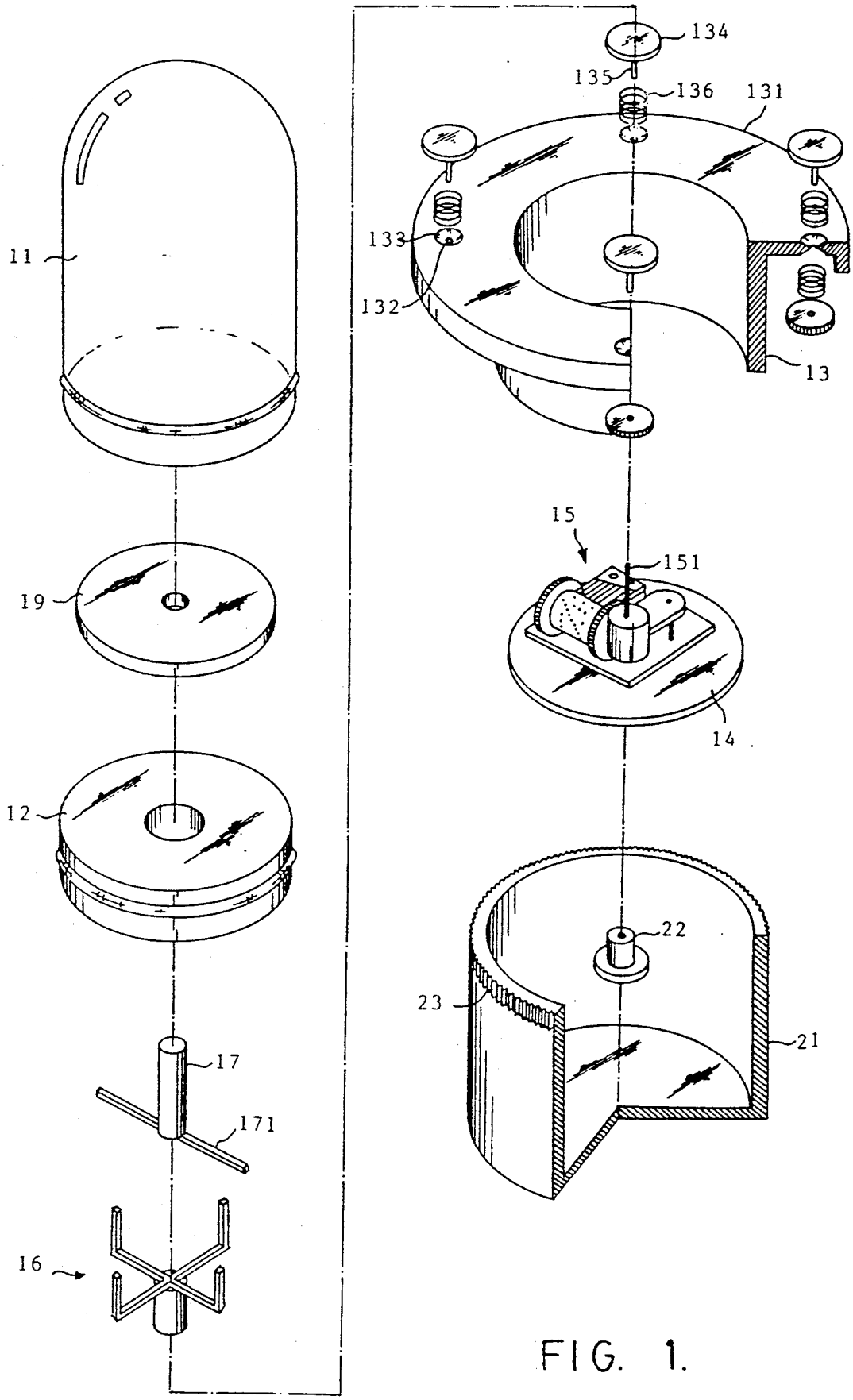
FIG. 1 is an exploded perspective view, partly in cross-section showing the assembly of the present invention.
Figure 2:
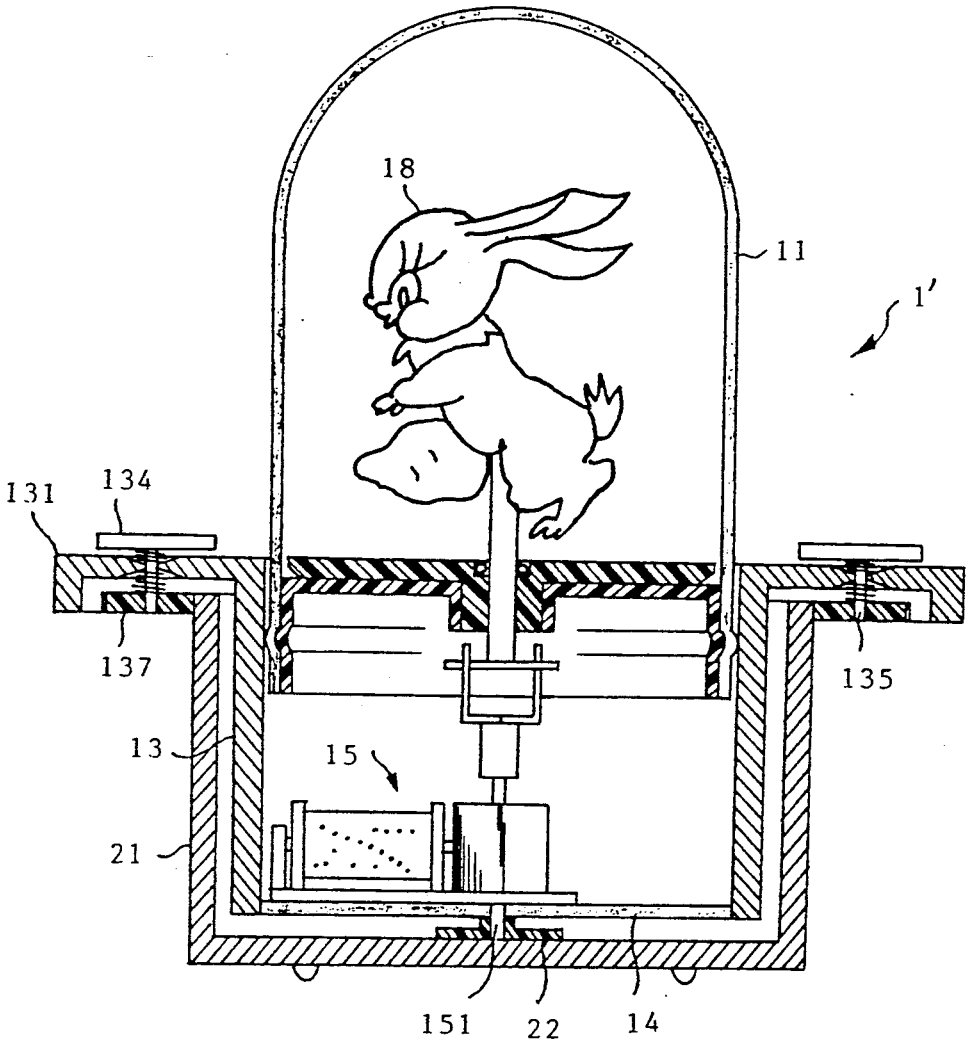
FIG. 2 is a cross-sectional view of the present invention.

In the configuration of a crystal ball 1' according to the present invention, as illustrated in FIG. 1 and FIG. 2, the flange of the upper end of casing 13 of the crystal ball 1 of the prior art is extended radially outward to form an annular protrusion 131, and there is provided a fixed base 21 spaced below and enveloping or spaced concentrically around casing 13 up to the outer flange of said casing 13. A positioning member 22 is mounted to the lower end of torque axle 151 in place of wrench 20. Positioning member 22 fixes the separation of base 14 of crystal ball 1 from the bottom of the fixed base 21. By means of the aforesaid improved configuration, when torque axle 151 starts to revolve upon the restoration of the resilience of the spring, such revolution will now drive the music bell 15 to revolve around with the torque axis 151 as a result of that one end of torque axle 151 being fixed to the positioning member 22 at the bottom of the fixed base 21. In addition, cover 11 and casing 13 of crystal ball 1' is also rotated due to the activated music bell 15. However, doll 18, located within the crystal ball 1', does not move, but remains standing still since it is relatively static for the passive axis 17 against the crystal ball 1'.

By means of the transmission of the aforesaid configuration, crystal ball 1' revolves while doll 18 remains static, a movement completely in contrast to that of the prior art described supra with respect to FIG. 5. Therefore, the present invention will present different dynamic landscapes such as patterns or maps, and others, that have been attached to or painted on ball 11.

Furthermore, a plurality of axial holes 132 are distributed at equal angles at a predetermined proper radius of the protrusion 131 at the upper end of casing 13 of crystal ball 1'. At the upper protrusion 131, a shaft or axis 135 is snapped to a disk which becomes a revolving stage 134. A gear 137 is fixed at the lower end shaft 135, and engages with an annular gear rack 23 located at the top of fixed base 21 when fixed base 21 is moved in position depending on the incorporation between positioning member 22 and torque axis 151 of the crystal ball 1'. As a result, in addition to revolving stage 134 rotating about the ball axis along with the protrusion 131 when the crystal ball 1' is revolving about a stationary fixed base 21, revolving stage 134 also spins about its own axis due to the activated gear 137. Thus a versatile and dynamic landscape can be given to the crystal ball 1 by other decorating items (not shown) fitted onto revolving stage 134.

However, in the aforedescribed transmission configuration, more particularly with respect to the engagement between gear 137 of protrusion 131 with gear ring 23 on fixed base 21 it is crucial for there to be a facilitated power output that torque axle 151 of music bell 15 must be very precisely fitted to the center of the base 14 of the crystal ball 1, and that positioning member 22 of fixed base 21 be accurately positioned at the center. This permits normal engagement of gear 137 and annular rack 23. Otherwise, any bias from any member within will result in jammed engagement. Still, the process cost will be relatively increased and it will be so very difficult to control the aforesaid members achieving such precision combination. To this, the present invention presents the following solutions.

Figure 3:
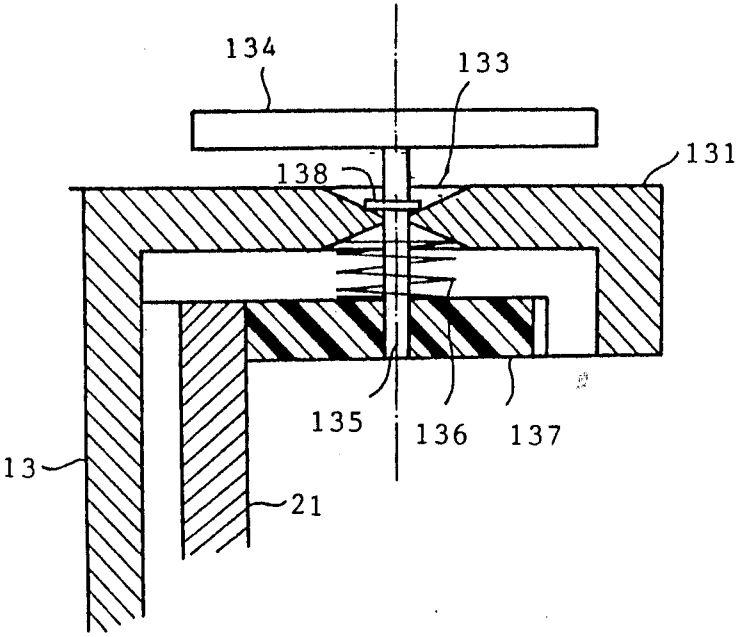
FIG. 3 is an enlarged cross-sectional showing details of the revolving stage and the protrusion.

As illustrated in FIG. 3, a concave recess 133 is formed at the upper and lower ends of each axial hole 132 in protrusion 131, thereby making the flange of the said axial hole 132 have a conical shape and the hole 132 have an hour-glass shape in cross-section. According to such design of axial hole 132, shaft 135 of revolving stage 134 in axial hole 132 will have an appropriate freedom of swing depending on said axial hole. Shaft 135 is provided with a radially protruding member 138 which bears against the upper one of concave recesses 133. In addition, a compression spring 136 is provided between axial hole 132 and the gear 137 to help shaft 135 maintain its vertical position as a result of the resilience of spring 136 when shaft 135 and the gear 137 become skewed. The spacing of the position of the axis of shaft 135 with respect to annular rack 23 on the external wall of fixed base 21 is preset to be slightly less (about 1–2 mm) than the radius of gear 137. In this way, when fixed base 21 and the torque axle 131 are joined together, gears 137 will have a proper slack against the engagement of annular rack 23, but in no way will such pressing have any effect on the transmission of power in the present invention after assembly.

Figure 4:
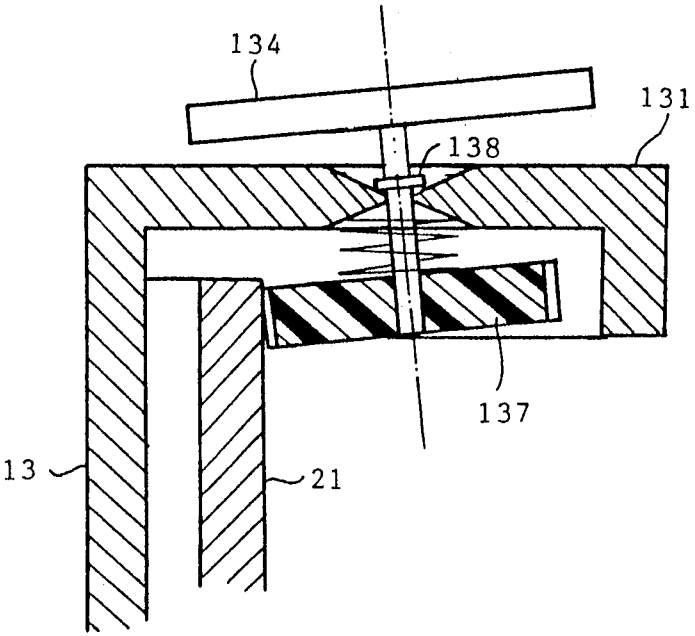
FIG. 4 is a cross-sectional view similar to FIG. 3, but illustrating the engagement of the gear with the annular rack when there is a biased axis of the revolving stage.

Should there be any bias to the position of the aforesaid members when assembled, the spacing will fail to be even between the position of the core of each axis 135 mounted in axial hole 132 and the annular rack 23 at the outer wall of fixed base 21. Should such spacing become narrower, as illustrated in FIG. 4, shaft 135 will tilt outwards a certain degree so as to maintain gear 137 engaged in transmission with annular rack 23. On the opposite side, the spacing gets relatively larger, which can be absorbed by the reserved spacing of the radius which is slightly shorter than the said gear 137. According to the assembly of the aforesaid members, even if there is any bias of the assembled components (if such bias should fall within the scope of approximately 1–2 mm) each gear 137 is still able to maintain effective transmission engagement with annular rack 23.

To sum up, the present inventor employed the combination of the fixed base and the torque axis of music bell to make the crystal ball revolve. Further by means of such revolution of the crystal ball, the gears disposed among the annular rack on the fixed base will be rotated and will in turn rotate the revolving stages on their own axes so as to enable the present invention to present multiple dynamic landscapes, which gives an innovative configuration.

What is claimed is:

1. A crystal ball having a revolving external configuration comprising:

a casing comprised of a substantially vertically extending, external wall, a flange at the upper end of said wall, and a bottom, said flange having a plurality of axial orifices therethrough;

a cover mounted to the top of said casing;

a music bell having a spring driven, vertical torque axle mounted on said casing bottom such that said torque axle is located at the center of said casing bottom;

a fixed base concentrically enveloping said casing and having a corresponding bottom, a corresponding substantially vertically extending, external wall, and an annular rack mounted at the upper end of said base wall, said base bottom and said base wall being respectively spaced from said casing bottom and said casing wall;

a positioning means mounted at the center of said fixed base bottom for positionally mounting said music bell torque axle so as to maintain a proper spacing between said fixed base bottom and said casing bottom, and so as to permit the rotation of said casing and said cover relative to said stationary fixed base upon the driving force of said torque axle;

a revolving stage mounted in each said axial orifice of said casing flange, said stage comprising a shaft extending through said axial orifice, a platform mounted at the upper end of said shaft, a gear mounted to the lower end of said shaft below said flange such that said gear can engage said annular rack, and a compression spring resiliently mounting said gear in said axial orifice, whereby rotation of said casing causes said gears to rotate around said annular rack, thereby rotating each said stage.

2. A crystal ball as claimed in claim 1, wherein said axial orifice has a concave, flared upper opening and a concave, flared lower opening.

3. A crystal ball as claimed in claim 2, wherein the spacing between said stage shaft when mounted in said axial orifice and said annular rack is slightly less than the radius of said gear.

4. A crystal ball as claimed in claim 2 wherein said stage shaft further comprises a radially protruding member located on said shaft above the narrower part of said orifice so that said member can bear on the surface forming said upper concave, flared opening.

5. A crystal ball as claimed in claim 1, wherein the spacing between said stage shaft when mounted in said axial orifice and said annular rack is slightly less than the radius of said gear.

6. A crystal ball as claimed in claim 5, wherein said spacing is slightly less by approximately 1–2 mm than the radius of said gear.

7. A crystal ball as claimed in claim 1, wherein said axial orifices are equiangularly located around said casing flange.

8. A crystal ball as claimed in claim 1 wherein said compression spring is mounted around said stage shaft between said casing flange and the top of said gear.

9. A crystal ball as claimed in claim 1 and further including a substantially vertical shaft mounted inside said cover; and an ornamentation mounted on said vertical shaft, said ornamentation being stationary as said cover is rotated.

* * * * *